United States Patent [19]

Gerhartz

[11] Patent Number: 4,667,889

[45] Date of Patent: May 26, 1987

[54] STEPPED PRECISION WINDING PROCESS

[75] Inventor: Siegmar Gerhartz, Remscheid, Fed. Rep. of Germany

[73] Assignee: Barmag AG, Remscheid, Fed. Rep. of Germany

[21] Appl. No.: 836,256

[22] Filed: Mar. 5, 1986

[30] Foreign Application Priority Data

Mar. 5, 1985 [DE] Fed. Rep. of Germany ..... 3507632
Apr. 25, 1985 [DE] Fed. Rep. of Germany ..... 3514875
Jun. 29, 1985 [DE] Fed. Rep. of Germany ..... 3523322

[51] Int. Cl.[4] ..... B65H 54/38
[52] U.S. Cl. ..... 242/18.1
[58] Field of Search ..... 242/18.1, 18 DD, 43 R

[56] References Cited

U.S. PATENT DOCUMENTS 4,504,021 3/1985 Schippers et al. ..... 242/18.1
4,504,024 3/1985 Gerhartz ..... 242/18.1

FOREIGN PATENT DOCUMENTS 2649780 5/1977 Fed. Rep. of Germany .

*Primary Examiner*—Stanley N. Gilreath
*Attorney, Agent, or Firm*—Bell, Seltzer, Park & Gibson

[57] ABSTRACT

A method and apparatus for producing ribbon free wound yarn packages is disclosed. In accordance with the method, a textile yarn is wound into a core supported package while the yarn is guided onto the core by a traversing yarn guide. The speed of the traversing yarn guide is proportional to the rotational speed of the package to define a substantially constant winding ratio during each of a series of sequential steps of the winding operation. The speed of the traversing yarn guide rapidly increases at the beginning of each of the sequential steps to produce a stepped precision wind. During at least some of the steps of the precision wind process, the winding ratio is varied from a predetermined ideal winding ratio by a series of recurring deviations, thereby avoiding the formation of undesirable patterns on the surface of the package.

11 Claims, 4 Drawing Figures

STEPPED PRECISION WINDING PROCESS

The invention provides a method of winding yarns, for example, the method of winding synthetic filament yarns in spinning and drawing machines. Synthetic filament yarns are yarns of thermoplastic materials such as polyester (polyethylene terephthalate) and polyamides (nylon 6, nylon 6.6). Typically, each filament yarn consists of a plurality of individual filaments and they are commonly called multifilament.

In winding such synthetic multifilament yarns using a random wind process, patterns commonly referred to as ribbons may be formed. More specifically, in random winding the package circumferential speed and the yarn traversing speed are constant. As a result, the winding ratio, i.e., the ratio of the speed of the package winding spindle to the double stroke rate of the yarn traversing system decreases during the winding cycle. Ribbons form when the winding ratio becomes an integral number or reaches a value which differs by a large fraction from the next integral winding ratio. In this context, a large fraction is a fraction in which the denominator is a small integral number, such as for example one-half, one-third, one-fourth.

In a precision wind, the package is built up at a yarn traversing speed which is directly proportional to the speed of the package winding spindle. As a result, in a precision wind the winding ratio is a fixed value and remains constant during the course of the winding cycle whereas the yarn traversing speed decreases proportionally to the package winding spindle speed with the winding ratio as a factor of proportionality. A package formed by precision winding may have advantages over a package built up by random winding. In particular, in a precision wind pattern formation is avoided by selecting the proper winding ratio.

The stepped precision wind differs from the precision wind in that the winding ratio remains constant only during given phases or steps of the precision wind cycle. From step to step, the winding ratio is reduced in jumps by suddenly increasing the yarn traversing speed. Stated another way, in a stepped precision wind, a precision wind occurs within each phase or step during which the yarn traversing rate decreases proportionally with the winding spindle speed. At the end of each step, the yarn traversing speed is suddenly increased so that a decrease in winding ratio results. In implementing the process, it is necessary that the winding ratios for the individual steps be accurately determined and accurately maintained.

A winding method is disclosed in German AS No. 26 49 780, which utilizes a stepped precision wind having only a few winding ratios which are integral ratios. This is possible, because the yarn tension is simultaneously regulated. However, where simultaneous yarn tension regulation is not employed, changes of the yarn traversing speed must be selected sufficiently small to maintain the yarn tension within acceptable limits.

For this reason, upper and lower limits are predetermined for the yarn traversing speed, and the yarn traversing speed is allowed to vary only between these values. The range between the upper and lower limits is selected sufficiently narrow to assure that variation of the yarn traversing speeds does not lead to unacceptable changes in yarn tension. Likewise, winding ratios likely to result in unacceptable pattern formations must be avoided. Therefore, great care and accuracy must be exerted in predetermining the winding ratios to be successively used, and in case of doubt, tests should be conducted to verify whether the predetermined winding ratios do in fact result in undesirable patterns.

It has been found that the winding ratios which are to be successively preset, can be very accurately calculated, so that a good precision wind should theoretically result. However, when this winding process is implemented using a series of stepped winding ratios which are theoretically sufficiently accurate to prevent the formation of ribbons, thick bulges in a rhombic pattern on the package surface often develop. It has not been possible to avoid this phenomenon by a still more accurate predetermination of the winding ratios to be used during the steps of the winding process.

It has been further found that in order to achieve an optimal yarn deposit, the winding ratios must not only be determined with great accuracy, but they must also be strictly maintained during the winding cycle. Under these circumstances, the accuracy measuring and control devices which are necessary for maintaining the proportionality between the package spindle winding speed and the yarn traversing speed, for each of the steps of the stepped precision winding process, reach their practical economic limits.

It is accordingly an object of the present invention to provide a stepped precision winding process which overcomes the above limitations of the prior art methods.

It is a more particular object of the present invention to provide a stepped precision winding process adapted for producing high quality packages having a large diameter, even when the technological limits of the accuracy of the electronic and mechanical components do not permit the exact maintenance of the winding ratios which have previously been determined to be optimal.

These and other objects and advantages of the present invention are achieved in the embodiments illustrated herein by the provision of a winding method which includes winding a textile yarn into a core supported package to produce a stepped precision wind, and wherein the yarn is wound about the core at a substantially constant rate while the yarn is guided onto the core by a traversing yarn guide, and wherein the speed of the traversing guide is varied between an upper preset value and a lower preset value during each of a series of sequential steps of the winding operation by decreasing in each of the steps the speed of the traversing yarn guide proportionally to the rotational speed of the package to define a substantially constant winding ratio and by rapidly increasing the speed of the traversing yarn guide. The method includes the further steps of determining an ideal winding ratio for each of the steps of the winding operation, and varying the winding ratio from the ideal winding ratio in a series of recurring deviations during at least some of the steps of the winding operation. The maximum width of the deviations is preferably less than about 0.1 percent of the winding ratio.

In one preferred embodiment of the present invention, the method includes the further step of detecting the formation of undesirable patterns or bulges on the surface of the package being wound, such as by detecting noise or vibrations produced by the package, or by physically scanning to detect irregularities in the surface of the package, and varying the winding ratio in response to the detection of such irregularities.

The present invention is characterized in that an inaccuracy of the winding ratio is intentionally produced. In this regard, the invention recognizes that a nonintended inaccuracy has a uniform variation from the intended value and lies on one side of the intended value, so that the defects of the yarn deposit which are caused by the inaccuracy are uniform as to magnitude and phase direction. For example, the drive of the yarn traversing system might operate uniformly faster than predetermined by the program, and its speed would not fluctuate so to be at times faster and at times slower than the predetermined program. In accordance with the present invention, recurring or fluctuating deviations are introduced, which produce certain defects intentionally in the yarn deposit, which also fluctuate as to magnitude and phase direction. As a result, the consequences of these defects are not only eliminated, but the defects themselves are substantially avoided.

In accordance with the present invention, there are generated deviations of the traversing yarn speed from its calculated value which is proportional to the rotational package winding spindle speed. The deviations of the traversing yarn speed, given in percent of the calculated traversing yarn speed, correspond to substantially the same percentage of deviations of the ideal winding ratio. As per this invention, the deviations admitted to the traversing yarn speed are such that they lead to a maximum width of the deviations of the ideal winding ratio which is less than about 0.1 percent and preferably less than about 0.02 percent. It has been found that the percentage width of the deviations with respect to the winding ratio is substantially equal to the percentage of the width with respect to the yarn traversing speed.

Within the framework of the present application, the width of the deviations A is given by the following formula: $A=(KO-KU)\times 2/\ KO+KU$, with K being the winding ratio, KO the upper limiting value of the winding ratio, and KU the lower limiting value of the winding ratio. The mean winding ratio KM during a particular phase of the precision wind may be defined by the formula: $KM=(KO+KU)/2$.

Widths of the deviation of the traversing speed from its average value greater than about 0.5 percent must be avoided in order to assure that critical winding ratios are not reached, it being understood that critical winding ratios result in undesirable patterns.

The deviations of the present invention preferably fluctuate, and the frequency of the deviations should be greater than five per minute, preferably more than ten per minute. At frequencies greater than thirty per minute, complete elimination of the winding defects as discussed above can usually be achieved.

The recurring deviations of the present invention may be restricted to such portions of the winding cycle which experience shows are susceptible to winding defects, such as the formation of bulges. However, as noted above, the deviations may be instituted in response to the detection of undesirable patterns or bulges. In this regard, it should be noted that the formation of the bulges results in vibrations of the winding system, as well as noise. Sensors may be provided by which such disturbances may be detected, and the output signal from the sensors may be used to switch on the deviations. A further embodiment of the invention provides that the package surface is scanned, preferably optically or pneumatically, and that the deviations are switched on when the scanning operation detects bulges on the package surface.

It has also been found by tests that it may be useful to increase the width or magnitude of the deviations of the winding ratio during the course of the winding cycle, as a function of certain winding parameters, such as denier, yarn traversing speed, package length, and entire package thickness.

Some of the objects and advantages of the present invention having been stated, others will appear as the description proceeds when taken in conjunction with the accompanying drawings, in which FIG. 1 is a diagram of the winding ratio vs. package diameter, for a winding process which embodies the features of the present invention;

Figure 3:
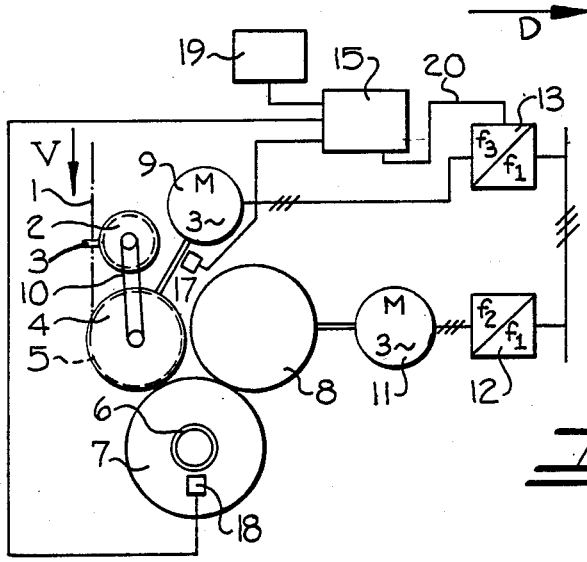
FIG. 3 is a schematic illustration of a typical winding machine adapted to perform the method of the present invention.

In the yarn winding apparatus illustrated schematically in FIG. 3, the yarn 1 advances at a constant speed v through a traversing yarn guide 3 which is driven by a cross spiraled roll 2 to reciprocate traversely across the package 7. The yarn traversing system also includes a grooved roll 4 which guides the yarn, partially looped, in its endless reciprocating groove 5.

The package 7 is mounted on the freely rotatable winding spindle 6. The drive to rotate the package 7 is provided by a package drive roll 8 which is in peripheral contact with the package 7, such that the circumferential speed of the package 7 remains constant. As is conventional, the yarn traversing system is radially movable with respect to the package 7 and the winding spindle 6, so that the distance therebetween can be varied as a diameter of the package 7 increases.

Drive for the cross spiraled roll 2 of the yarn traversing system and the grooved roll 4 is provided by a three-phase asynchronous motor 9 coupled to directly drive grooved roll 4. Cross spiral roll 2 and the grooved roll 4 are operatively coupled by a conventional drive belt 10 to be driven at a substantially constant rotational speed with respect to each other. Similarly, a second synchronous motor 11 provides drive to the package drive roll 8 such that the circumferential speed of the package drive roll 8 is substantially constant. Alternatively, the drive motor 8 may also be connected to directly drive the package winding spindle 6 and controlled such that the circumferential speed of the package 7 remains constant as the package diameter increases.

The three-phase motors, 11 and 9, receive their power from separate three-phase power sources comprising first and second inverters, 12 and 13, respectively. The inverters 12 and 13 are provided primary three-phase power by a primary conventional power bus.

The frequency f2 of the inverter 12 is selected to give the required circumferential speed to the package 8, and the motor 9 is controlled by the frequency f3 of the inverter 13, which is in turn controlled by a signal 20 from a computer 15. The control computer 15 calculates the rotational speed required for the motor 9.

A measuring sensor 18 is provided for monitoring the speed of the spindle 6, and the sensor 18 provides an output signal to the computer 15. The output signal from the programming unit 19 also is coupled to the computer 15, and the programming unit 19 is preferably freely programmable and supplied with the winding ratios which are to be successively run in the individual phases or steps during the course of the stepped precision winding process. Also, a measuring sensor 17 is provided for monitoring the actual yarn traversing speed, i.e., the double stroke rate, and the output of the sensor 17 is supplied to the computer 15. The computer conducts a comparison between the desired and actual values, and as a result, regulates the speed of the yarn traversing system by means of the motor 9 to achieve the desired value, i.e., a value proportional to the spindle speed as determined by the stored winding ratio.

The main task of the computer 15 is to determine the actual value of the yarn traversing speed. To this end, the computer is initially supplied with the stored winding ratios from the programming unit 19, and which are ideal in the meaning of the present invention. From each of these ideal winding ratios, and from the output value, for example the upper limiting value U of the traversing yarn speed, the computer determines an "ideal" spindle speed. However, the program unit 19 may similarly be supplied with the spindle speeds which are predetermined from the "ideal" winding ratios, and the upper (or lower, respectively) limiting value U of the traversing yarn speed, so that this operation need not be performed by the computer. In any event, the values of the "ideal" spindle speeds are compared with the actual spindle speeds measured by the sensor 18. When the computer finds that the actual spindle speed is identical with an ideal spindle speed, it supplies an output signal 20 to the frequency inverter 13 which is indicated by the programming unit 19 to be the nominal value of the traversing speed. During the following step of the winding process, the computer reduces this nominal value proportionally to the constantly measured spindle speed, which decreases hyperbolically as the package diameter increases with a constant circumferential speed of the package. Thus during this step of the winding process, the predetermined "ideal" winding ratio remains constant. As soon as the computer finds that the actually measured spindle speed corresponds with the "ideal" spindle speed of the next step, an output signal 20 is delivered which represents the ideal value of the traversing speed of the next step of the winding process.

Figure 1:
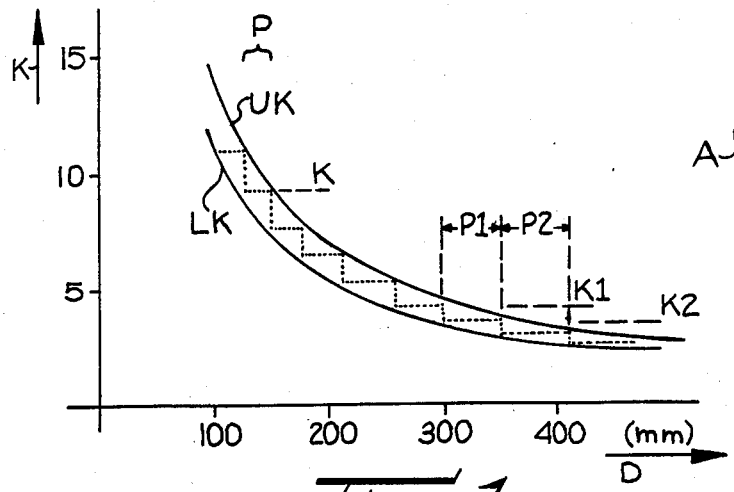
FIG. 1A is an enlargement of a portion of the diagram shown in FIG. 1.
Figure 2:
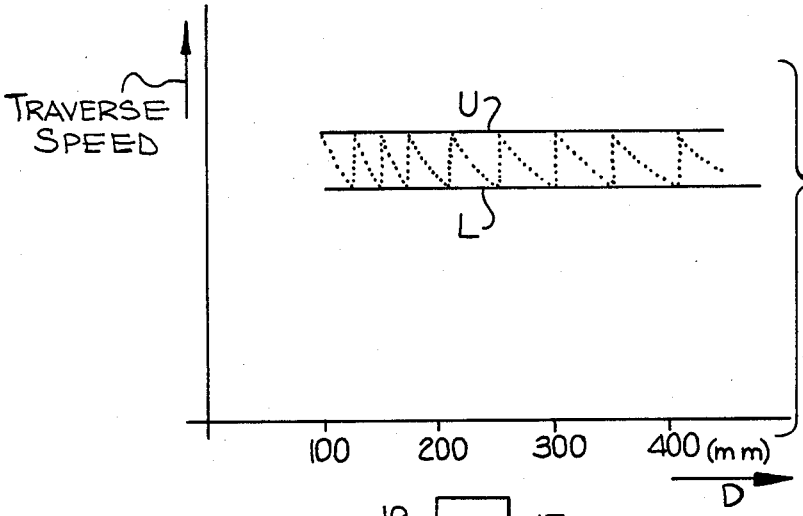
FIG. 2 is a diagram of traverse speed vs. package diameter for the winding process shown in FIG. 1.

Since the speed at which the yarn advances to the package is constant, for example, during spinning of a synthetic filament yarn, and since for this reason the circumferential speed of the package must remain constant despite its increasing diameter, the speed of the winding spindle decreases hyperbolically as the winding cycle proceeds. It is also required that the tension of the yarn on the package remains within certain limits, so as to effect a proper build of the package. For this reason, the yarn traversing speed must remain within given, relatively narrow limits U and L, as shown in FIG. 2. In so doing, an ideal winding ratio K is constantly preset and programmed for each phase P of the winding cycle or increase of the diameter. A constant winding ratio K during a winding phase means that the yarn traversing speed decreases proportionally to the spindle speed. However, the traversing speed can only decrease until the lower limiting value L is at least approximately reached, which also means until the upper limiting value UK of the winding ratio is reached as seen in the diagram of FIG. 1. At this point, the yarn traversing speed must again be suddenly increased to its upper limiting value U, and this sudden increase of the traversing speed results in a sudden decrease of the winding ratio K to its lower limiting value LK as seen in FIG. 1.

As a result of the foregoing, the upper limiting value U of the yarn traversing speed is, in the described embodiment, a fixed magnitude. which is repeatedly reached as the winding cycle proceeds. When this magnitude is reached, it is then adjusted along a predetermined ideal value which is related to the actual spindle speed. The lower limiting value L of the traversing speed however, is only a calculated magnitude, which indicates the maximum allowable drop in the traversing speed, which in reality is rarely or never reached, and which plays a role only in the calculation of the upper limiting value. It should be mentioned that the method may also be inverted, such that the lower limiting value of the traversing speed may be given as the real, repeatedly reached limiting value, and in this instance. the upper limiting value would indicate the then maximum allowable upward increase of the traversing speed. It is, however, in reality only approached in exceptional situations, when this upper limiting value, as related to the instantaneous spindle speed, happens to have a value which was predetermined as ideal.

In accordance with the winding process of the present invention, the winding ratio is varied from the ideal winding ratio in a series of recurring deviations during at least some of the steps of the winding operation. This aspect of the present invention is illustrated schematically in FIG. 1A, which shows the recurring deviations in the form of a sinusoidal waveform having an equal amplitude on opposite sides of the ideal winding ratio. It should be understood however, that the amplitude and frequency of the illustrated sinewave are not to scale in order to more clearly illustrate the process.

As previously indicated, the yarn tension should fluctuate only within certain limits, so that the range between the limiting values or the yarn traversing speed U and L is very narrow. This means that two winding ratios K1 and K2 of two successive winding phases P1 and P2 need to be close together. However, the successive winding ratios must be selected so that there is no risk of pattern formation. As a result, the number of favorable winding ratios to be selected becomes relatively restricted, and it cannot be avoided that a favorable winding ratio K1 is very close to an unfavorable winding ratio which may cause the formation of ribbons or bulges. Thus for example, it was necessary to select for K1 a winding ratio of 4.08631, which results in a very favorable package build when accurately maintained, and this was shown to be the case when this winding ratio was tested in laboratory operation. However, in practical operation, it was found that there appeared to be a very pronounced formation of bulges, despite the correct determinarion of the winding ratio. Measurements of the spindle and traversing speeds showed that the winding ratio was acrually 4.08696, and despite this very slight deviation of only 0.015 percent, the result was an unsatisfactory package build which was caused by a variance between the actual winding ratio and the winding ratio which was precalculated as being proper. According to the invention, the first mentioned winding ratio of 4.08631 was preset wthout requiring an increase in the accuracy of the acquisition of the measured data, or the adjustment and regulation of the yarn traversing speed, and deviations were introduced to the nominal value in the form of a theoretical sine curve. In particular, the pertinent nominal value of the traversing speed was varied by plus or minus 0.005 percent at a frequency of the deviations of 20 per minute.

The above deviation step, which can be carried out in an electronically and electrically simple manner, resulted in the entire elimination of undesirable bulges, and the production of a satistactory package build. It further showed that the package build improved as the frequency of the deviations increased.

During the course of a winding cycle in which winding ratios between 7.1227 and 1.3599 were passed, the value of the width of the deviations was uniformly raised by 0.01 percent of the respective ideal winding ratio each time the winding ratio was lowered, which resulted in a satisfactory package build.

Figure 1A:
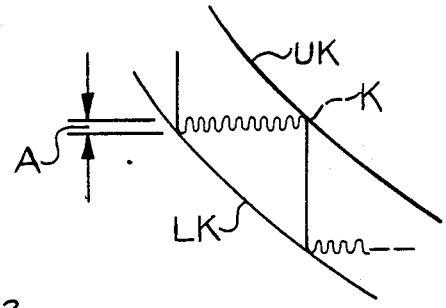

To accomplish the modulation of the yarn traversing speed, a deviation program for the sinusoidal modification of the traversing speed may be additionally supplied to the programming unit 19, which produces a sinusoidal waveform for the winding ratio as seen in FIG. 1A, and which has an equal amplitude on opposite sides of the ideal winding ratio which is represented by the dashed line. Such program could provide a constant or variable amplitude of the deviations, which may for example increase during the course of the winding cycle. The width (A) of the deviations as provided by the present invention, is in any case less than 0.5 percent, and preferably less than about 0.1 percent. For example, in winding multifilament yarn of less than 200 denier, the maximum width of deviations is not more than aoout 0.1 percent. It should be emphasized that the width of the deviations should be selected as narrow as possible, since the quality of the package build may thus be improved. However, the closeness of the winding ratios must also be considered, to avoid unacceptable changes in the yarn tension, while still achieving a good package build. The lesser the difference between the winding ratios, the smaller must be the selected width of the deviations.

In the drawings and specification, there has been set forth a preferred embodiment of the invention, and although specific terms are employed, they are used in a generic and descriptive sense only and not for purposes of limitation.

That which is claimed is:

1. A method of windng a textile yarn into a core supported package to produce a stepped precision wind, and wherein the yarn is wound about the core at a substantially constant rate while the yarn is guided onto the core by a traversing yarn guide, and wherein the speed of the traversing yarn guide is varied between an upper preset value and a lower preset value during each of a series of sequential steps of the winding operation by decreasing in each of the steps the speed of the traversing yarn guide proportionally to the rotational speed of the package to define a substantially constant winding ratio and by rapidly increasing the speed of the traversing yarn guide, and including the steps of determining an ideal winding ratio for each of the steps of the winding operation, and varying the winding ratio from said ideal winding ratio in a series of recurring deviations during at least some of the steps of the winding operation, with the maximum width of the deviations being less than about 0.1 persent of the winding ratio.

2. A method in accordance with claim 1 wherein the maximum width of the deviations is less than 0.02 percent.

3. A method in accordance with claim 1 in which the deviations from the ideal winding ratio occur at a frequency of more than about ten per minute.

4. A method in accordance with claim 3 in which the deviations from the ideal winding ratio occur at a frequency of more than about thirty per minute.

5. A method in accordance with claim 1 further including the step of increasing the magnitude of said recurring deviations from said ideal winding ratio during at least a portion of the winding cycle.

6. A method in accordance with claim 1 wherein said recurring deviations take the form of a sinusoidal waveform having an equal amplitude on opposite sides of the ideal winding ratio.

7. A method of winding a textile yarn into a core supported package to produce a stepped precision wind, and wherein the yarn is wound about the core at a substantially constant rate while the yarn is guided onto the core by a traversing yarn guide, and wherein the speed of the traversing yarn guide is varied between an upper preset value and a lower preset value during each of a series of sequential steps of the winding operation by decreasing in each of the steps the speed of the traversing yarn guide proportionally to the rotational speed of the package to define a substantially constant winding ratio and by rapidly increasing the speed of the traversing yarn guide, and including the steps of determining an ideal winding ratio for each of the steps of the winding operation, detecting the formation of undesirable patterns or bulges on the surface of the package being wound, and varying the winding ratio from said ideal winding ratio in a series of recurring deviations in response to the detection of undesirable patterns or bulges, and so as to terminate the formation of such undesirable patterns or bulges on the surface of the package.

8. A method in accordance with claim 7 wherein the maximum width of the deviations is less than about 0.1 percent of the winding ratio.

9. A method in accordance with claim 8 wherein said recurring deviations take the form of a sinusoidal waveform having an equal amplitude on opposite sides of the ideal winding ratio.

10. A method in accordance with claim 7 wherein the detecting step includes detecting noise or vibrations produced by the package being wound.

11. A method in accordance with claim 7 wherein the detecting step includes scanning the surface of the package to detect irregularities thereon.

* * * * *